US005428868A

United States Patent [19]

Safdeye et al.

[11] Patent Number: 5,428,868

[45] Date of Patent: Jul. 4, 1995

[54] RETRACTABLE HANDLE

[75] Inventors: Alan Safdeye, West Long Branch; Christina Bogart, Glen Ridge, both of N.J.

[73] Assignee: Capezio Luggage And Travelware, New York, N.Y.

[21] Appl. No.: 147,286

[22] Filed: Nov. 3, 1993

[51] Int. Cl.[6] ..... B25G 1/04

[52] U.S. Cl. ..... 16/115

[58] Field of Search ..... 16/115, 110 R, 111 A, 16/DIG. 41, DIG. 38; 190/115, 116, 117, 118; 280/37

[56] References Cited

U.S. PATENT DOCUMENTS

| | | | |
|---|---|---|---|
| 4,087,102 | 5/1978 | Sprague | 280/37 |
| 4,358,005 | 11/1982 | Fontana | 190/18 A |
| 5,197,579 | 3/1993 | Bieber et al. | 190/115 |
| 5,323,887 | 6/1994 | Scicluna et al. | 190/115 |
| 5,339,934 | 8/1994 | Liang | 190/115 |

*Primary Examiner*—P. Austin Bradley

*Assistant Examiner*—Chuck Y. Mah

*Attorney, Agent, or Firm*—Amster, Rothstein & Ebenstein

[57] ABSTRACT

A handle mechanism for luggage or the like, the handle mechanism comprising a generally U-shaped handle member having a grasping portion, two axially elongated rods in spaced-apart parallel relationship, and an integral cross-rod including a portion transversely disposed relative to the axially elongated rods to form the bottom end of the handle member, the axially elongated rods and cross-rod being joined in a pivotal connection to permit pivoting the cross-rod relative to the axially elongated rods, the handle mechanism further including a housing for slidably receiving the handle member therein, the housing having a first detent provision for retaining the handle member in a retracted position and a second detent provision for retaining the handle member in an extended position, where the pivotal connection between the cross-rod and axially elongated rods facilitate smooth engagement with the locking detents.

15 Claims, 6 Drawing Sheets

RETRACTABLE HANDLE

BACKGROUND

1. Field Of The Invention

The present invention relates generally to a retractable handle mechanism, and more particularly, to a handle mechanism suitable for luggage or the like which employs a novel locking apparatus to ensure positive and secure engagement between the handle and the mechanism housing when the handle is disposed in a stowed or extended position.

2. Description Of The Prior Art

Luggage assemblies which incorporate wheels or rollers to facilitate transport thereof in combination with some type of handle provision are well known in the art. There are many patents directed to such designs, most of which have extendable handle locking mechanisms which suffer from relatively complex construction and excessive fabrication costs. The following is a brief overview of the prior art.

U.S. Pat. No. 5,108,119 to Huang is directed to a wheel-equipped carrying case having an extendable U-shaped handle which can be stored when the case is not in use. The extendable handle is slidably disposed in large diameter storage tubes mounted on the bottom of the case and locked in an extended position by spring-loaded buttons which pop up through holes in the handle tubing and storage tubing when the handle is fully extended.

U.S. Pat. No. 5,048,649 to Carpenter et al., teaches a telescoping rigid handle slidably disposed within a tubular sheath attached to a luggage container. Engagement between a stop integral with the handle and a washer on the tube prevents removal of the handle from the tube when disposed in a fully extended position, and the washer provides a frictional fit for maintaining the handle in an intermediate position. The handle is spring-loaded relative to the receiving tube so as to spring back into vertical alignment therewith for storage.

U.S. Pat. No. 4,995,487 to Plath, is directed to a luggage assembly in which a laterally extendable U-shaped handle is slidably received within a pair of elongated sleeves in a friction fit between an offset cylindrical disk and the sleeve interior.

U.S. Pat. No. 5,181,590 to Carpenter et al., teaches a frame for luggage which includes a pull handle assembly having a pull handle slide which is affixed to the main frame by a triangular shaped bracket, a molded plastic rectangular pull handle which slides in the pull handle slide in a vertical direction and a flat spring attached to an oblong-shaped transverse bar of the pull handle. A spring clip is employed to receive and hold the pull handle in an extended position, and the user can rotate the handle to the desired angle of inclination for pulling the luggage on a pair of wheels.

U.S. Pat. No. 5,167,306 to Carrigan, Jr., is directed to a combined luggage and cart apparatus in which a U-shaped handle cooperates with a pair of sleeves respectively disposed in a pair of elongated legs and a pair of split rings insertable through the sleeves and held captive on the handle. The sleeve includes a locking tab to engage the leg and the split ring engages the sleeve when the handle is placed in use.

Other patents directed to handles for luggage include U.S. Pat. No. 5,116,289 to Pond et al., in which a carry-on case has a built in telescoping handle assembly; U.S. Pat. No. 3,948,365 to Gregg et al., in which a luggage case has a handle assembly foldably received into a sidewall of the case; U.S. Pat. No. 4,358,005 to Fontana, in which a handle is pivotally disposed relative to a case and stored vertically against the side of the case; U.S. Pat. No. 5,075,925 to Maloney, in which a pivoting retractable handle assembly is storable against the side of a suitcase; U.S. Pat. No. 5,197,579 to Bieber et al., wherein a rigid handle is slidably disposed within a sheath disposed within the case interior similar to U.S. Pat. No. 5,048,649 to Carpenter et al.; and U.S. Pat. No. 4,966,259 to Bergman, in which an aircraft carry-on bag is provided with a generally U-shaped handle pivotally attached to one corner and storable against the exterior thereof.

SUMMARY OF THE INVENTION

The present invention provides a luggage handle for a suitcase of the type having rollers to facilitate transport thereof, wherein the handle mechanism comprises a handle member slidably disposed within a housing which is affixed to a portion of the suitcase.

The handle member is generally U-shaped having two axially elongated rods in spaced-apart parallel relationship and an integral cross rod including a portion thereof transversely disposed relative to the axially elongated rods to form the bottom end of the handle member. The axially elongated rods are attached to the cross-rod in a pivotal connection such that the cross-rod can pivot relative to the axially elongated rods to facilitate locking and unlocking the handle member relative to housing as described below.

The handle member is slidably received within the elongated housing in an interior volume defined therein. The housing is defined by two generally elongated sidewalls, a lower transverse sidewall and an upper transverse sidewall, the sidewalls being integral with an elongated front wall to form the interior volume of the housing and the upper transverse sidewall defining at least one aperture therethrough for receiving the elongated rods of the handle member. The housing includes integrally raised protrusions in the front wall disposed proximal to the lower transverse sidewall for restricting axial movement of the handle member away from the lower transverse sidewall of the housing when in the retracted position, and further comprises a second integrally molded protrusion disposed proximal to the upper transverse sidewall for restricting axial movement of the handle member away from the upper transverse sidewall of the housing when the handle is in the extended position. When in the extended position, the handle is adapted to pivot relative to the housing to enable the user to find a comfortable carrying position. When the handle is pulled from the retracted position for extension and pushed from the extended position for retraction, the pivotal connection permits effective bending of the handle within the housing as the cross-rod rides up and over the respective raised protrusion. This provides a handle mechanism of simple yet durable construction which ensures a snug fit with the housing so as not to inadvertantly release from either locked position.

In accordance with the present invention, it is an object thereof to provide a retractable luggage handle mechanism for a suitcase having new and improved means for retaining the handle member with respect to the housing when disposed in the retracted or extended positions.

It still another object of the invention to provide a retractable luggage handle mechanism for a suitcase having a handle member constructed of pivotally joined separate portions to facilitate locking the handle member within the housing.

It is a further object of the invention to provide a retractable luggage handle mechanism which is economical to manufacture, easy to use and rugged in construction for long-term durability.

In accordance with these and other objects which will become apparent hereinafter, the present invention will now be described with particular reference to the accompanying drawings,

DETAILED DESCRIPTION OF THE PREFERRED EMBODIMENT

Figure 1:
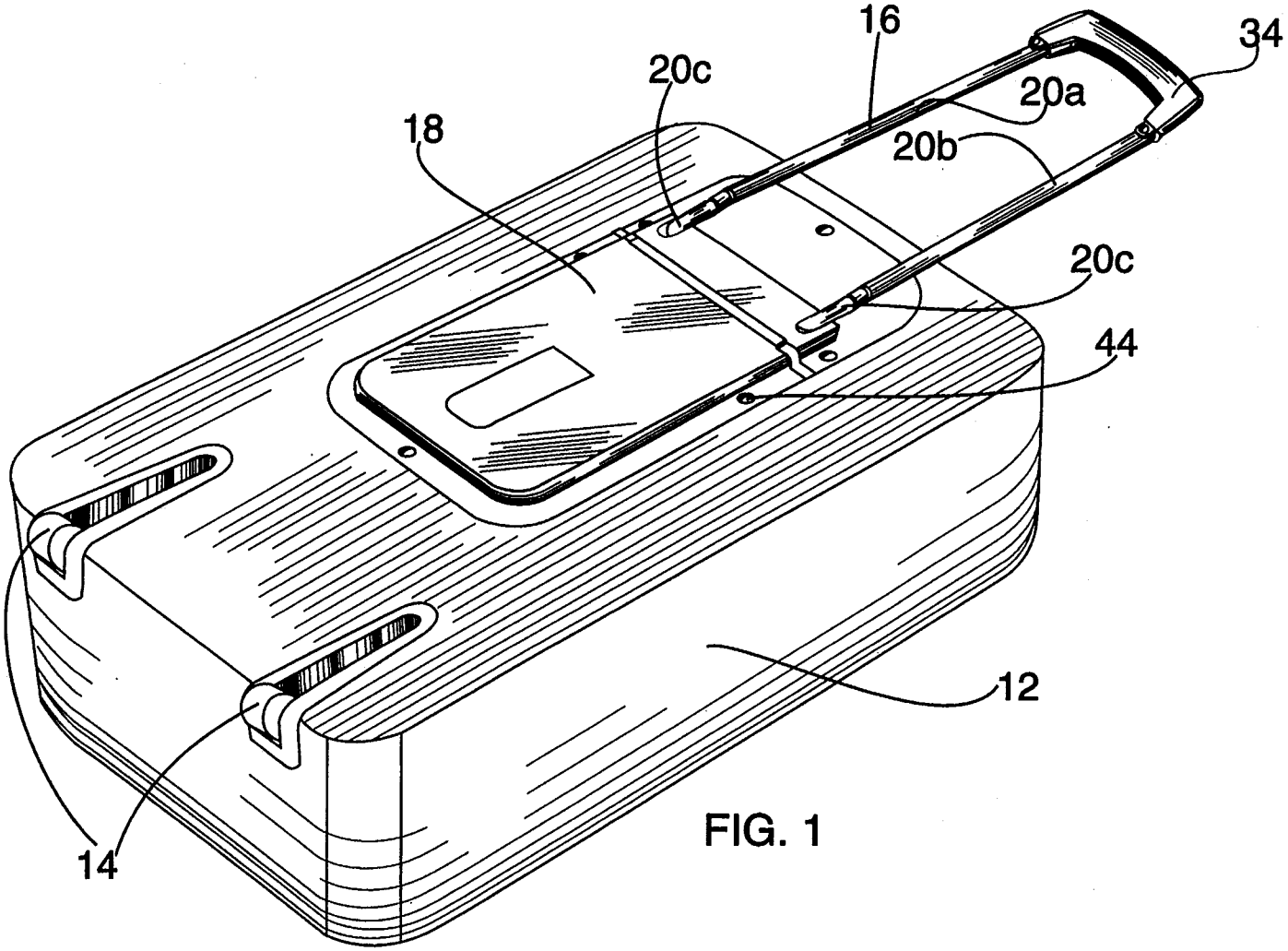
FIG. 1 is a perspective view of a carrying case with the handle mechanism of the present invention.

With reference to the several views of the drawings, the present invention provides a retractable luggage handle mechanism 10 for use with a suitcase 12 of the type having rollers 14 to facilitate transport thereof. The handle mechanism is generally comprised of a U-shaped handle member 16 which is slidably received within an elongated housing assembly 18.

Figure 2A:
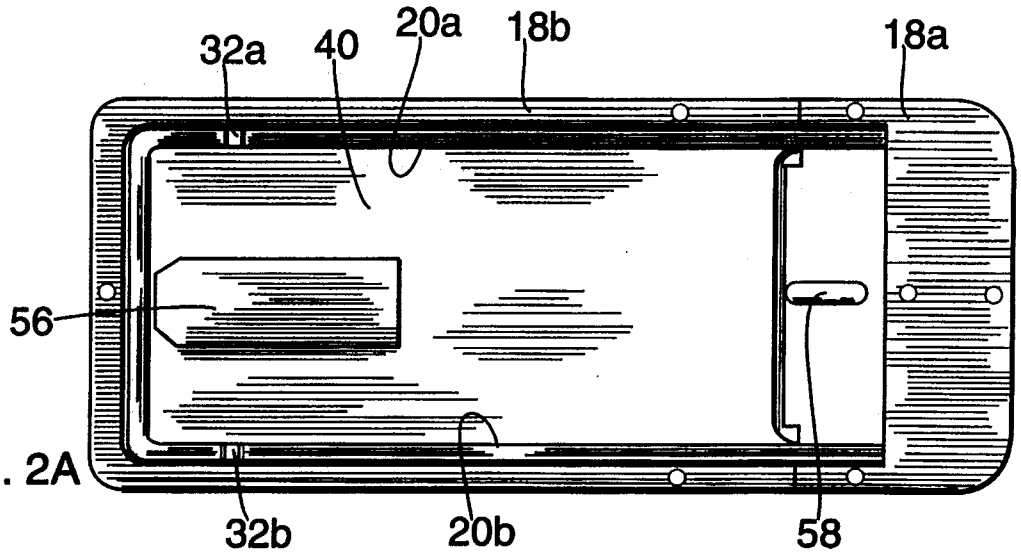
FIG. 2A is a top plan view of the interior of the housing with the handle member disposed and locked in a retracted position.
Figure 2B:
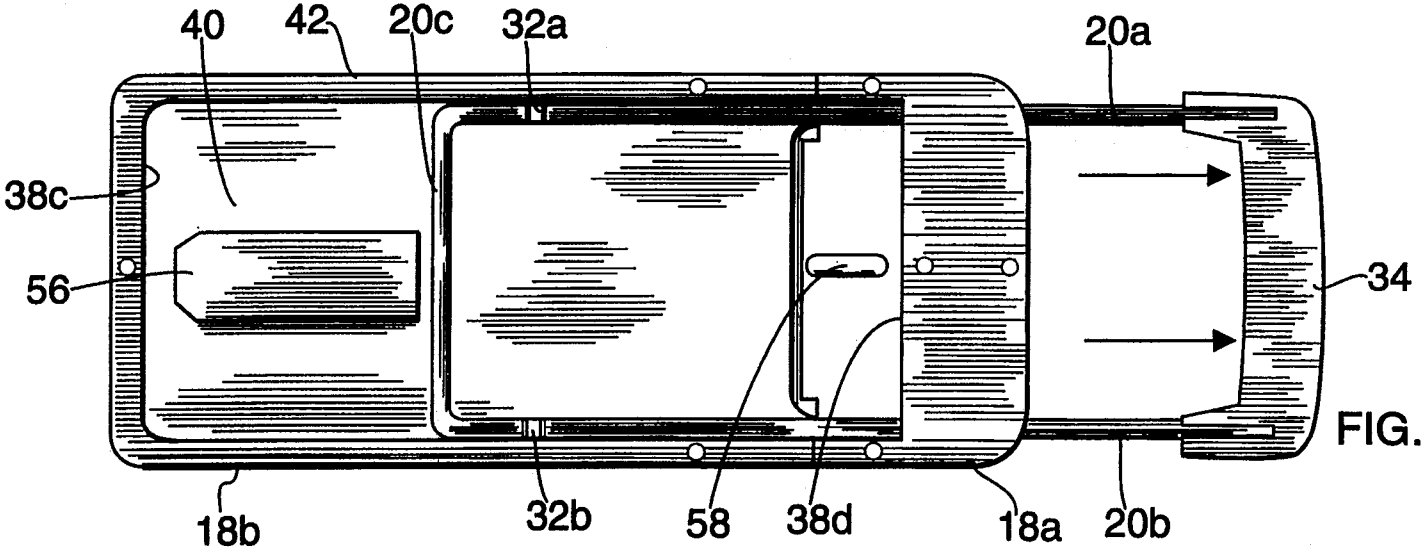
FIG. 2B is a top plan view of the interior of the housing with the handle member disposed in an intermediate position.
Figure 3:
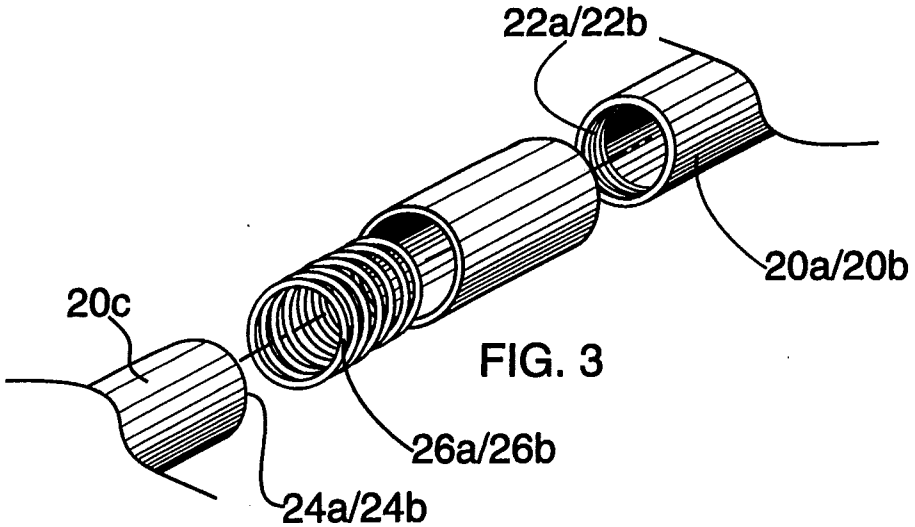
FIG. 3 is a fragmentary view of the pivotal connection between the axially elongated rods (first portion) of the handle member and the cross-rod (second portion) of the handle member.

As shown in FIGS. 1, 2A and 2B, the handle member 16 includes two axially elongated rods, **20*a*, 20*b* in spaced-apart parallel relationship to form a first portion of handle member 16 and an integral cross-rod 20*c* transversely disposed relative to rods 20*a*, 20*b* to form the bottom end or second portion of handle member 16. In the preferred embodiment, rods 20*a*, 20*b* include respective mating ends 22*a*, 22*b* which interface with cross-rod 20*c* as illustrated in FIG. 3. Cross-rod 20*c* is U-shaped and includes respective mating ends 24*a*, 24*b*. Elongated rods 20*a*, 20*b* and cross-rod 20*c* are pivotally attached to permit relative movement therebetween for the purpose of locking the handle within housing 18** as described in further detail below.

Figure 4:
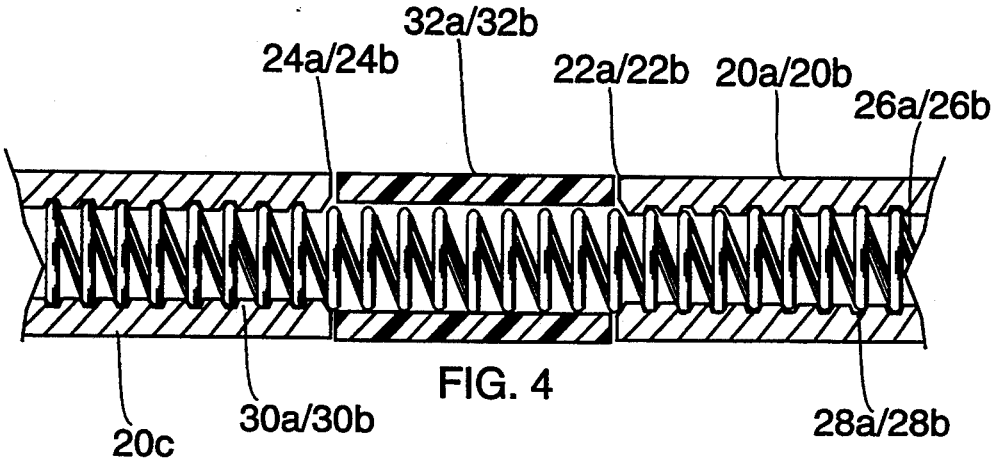
FIG. 4 is a sectional detail of the pivotal connection depicted in FIG. 3.

In one embodiment, respective spring elements **26*a*, 26*b* are disposed between mating ends 22*a*, 24*a* and 22*b*, 24*b* to form this pivotal connection. As depicted in FIGS. 3 and 4, the spring is threadably retained within the respective ends of the rods by respective female threads 28*a*, 28*b*, in rods 22*a*, 22*b* and respective female threads 30*a*, 30*b* disposed proximal to ends 24*a*, 24*b* of cross-rod 20*c*. An elastic collar or sheath 32*a*, 32*b* is respectively disposed over springs 26*a*, 26*b*** to provide a durable flexible connection between the respective handle portions. To provide structural integrity, a bonding agent may be applied to the threaded interface. As an alternative to the threaded spring construction described above, any resilient material may be substituted in lieu thereof to provide a flexible or pivotal connection between the respective handle members.

A grasping member 34 is fixedly attached to elongated rods **20*a*, 20*b* opposite cross-rod 20*c* and suitably sized for easy gripping thereof by a human hand. The grasping member 34 can be fabricated from molded plastic or the like and either mechanically attached to rods 20*a*, 20*b*** in a conventional fashion such as with a pair of fasteners and/or by bonding or equivalent means.

The entire handle assembly 16 is slidably disposed within housing 18 which in turn is fixedly attached to a portion of suitcase 12 as shown in FIG. 1. Referring to FIGS. 2A–2C, 5 and 6, housing 18 is constructed in an elongated, rectangular pan or dish shape and prescribes an internal volume 36 in which handle member 16 is disposed. Specifically, housing 18 is defined by two generally elongated sidewalls **38*a*, 38*b*, a lower transverse sidewall 38*c* and an upper transverse sidewall 38*d*, the sidewalls being integral with an elongated front wall 40 which forms the planar bottom side of the housing. The four sidewalls collectively define a peripheral flange 42 which circumscribes the housing and through which a plurality of rivets 44 or the like are disposed for attachment to suitcase 12**.

Figure 2C:
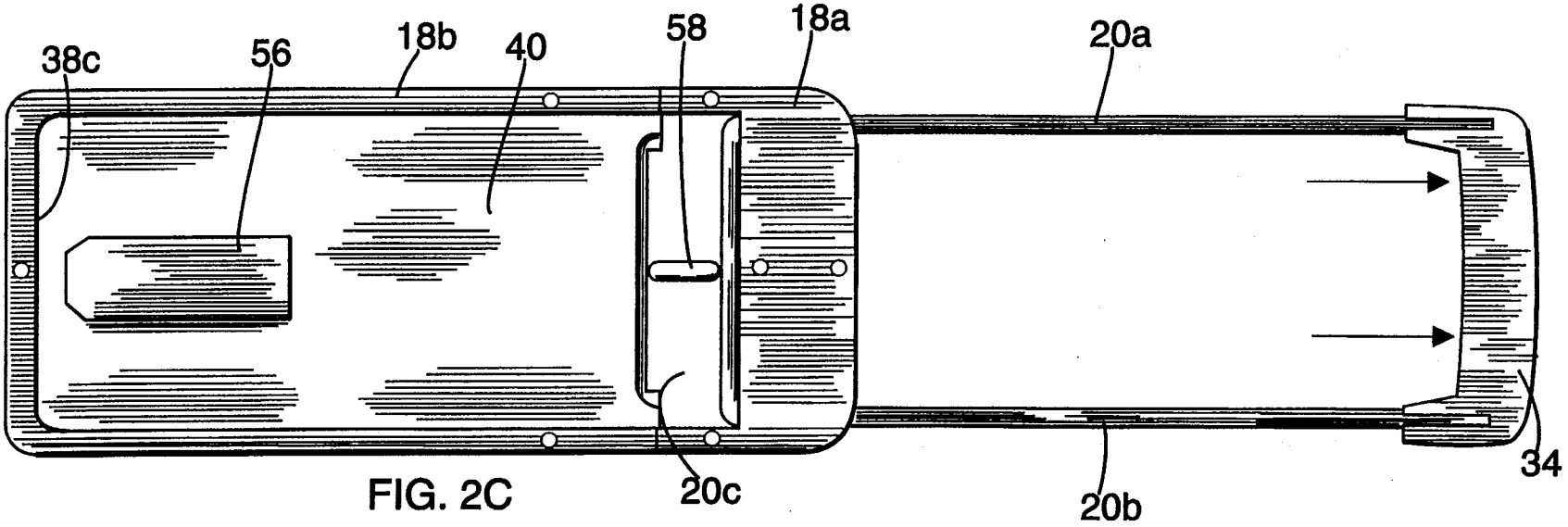
FIG. 2C is a top plan view of the interior of the housing with the handle member disposed and locked in an extended position.
Figure 5:
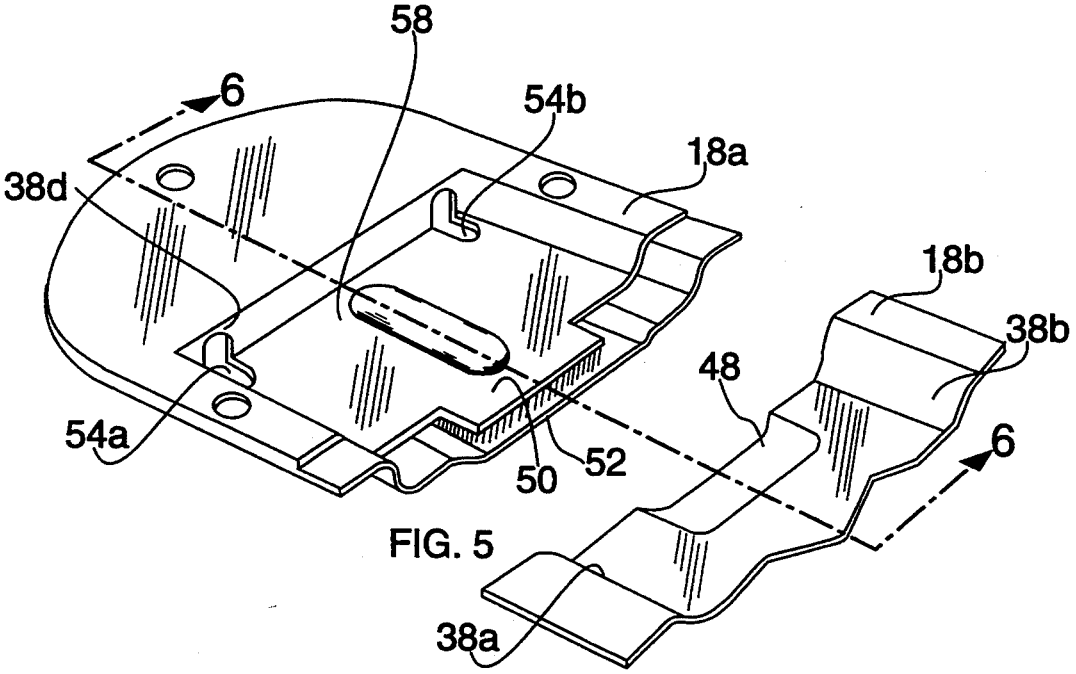
FIG. 5 is a partial fragmentary view of the split housing construction.
Figure 6:
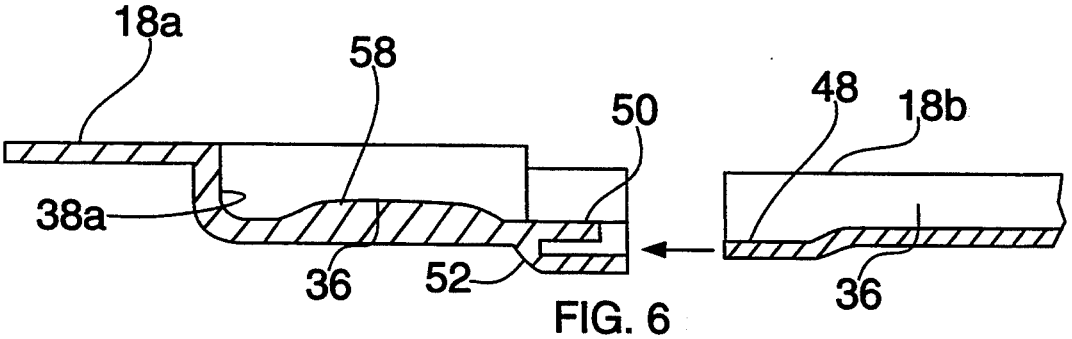
FIG. 6 is a sectional view of the split housing construction depicted in FIG. 5.

As shown in FIGS. 5 and 6, housing 18 is fabricated in two sections **18*a* and 18*b* which are joined in the assembly depicted in FIGS. 1 and 2A–2C by sliding sections 18*a* and 18*b* into engagement. The split construction provides ease of fabrication and reduced manufacturing complexity. As shown in the sectional view of FIG. 6, section 18*a* includes a depressed area 46 which mates with section 18*b* below flange 44 thereof. Similarly, section 18*b* contains a depressed area 48 which fits in the slot formed between tongue portion 50 and the joggled depression 52 of section 18a. Section 18*a* includes a pair of apertures 54*a*, 54*b* cut into walls 38*d* and 40 for receiving elongated rods 20*a*, 20*b* of handle member 16. Handle member 16 is adapted to slide within and along the longitudinal extent of housing 18 between a retracted (i.e., stowed) position (FIG. 2A) and an extended position (FIG. 2C). To secure the handle member, housing 18 includes a ramp-like surface 56 which forms a detent integral with front wall 40 in section 18*b* thereof to engage cross-rod 20*c* when the handle member is fully inserted into the housing against sidewall 38*c*. In this manner, the handle member is retained and prevented from inadvertent release away from the lower sidewall of the housing when in the retracted position. An integral raised ridge 58 is disposed in section 18***a* proximal to upper sidewall 38*d* to provide a detent for retaining handle member 16 in the extended position by preventing axial movement away from upper sidewall 38*d*. The configuration of apertures 54*a*, 54*b* in front wall 40 allows handle member 16 to pivot relative to housing 18 to provide a comfortable carrying position for the user.

In operation, when the user pulls on the grasping member 34 of handle member 16, the pivotal joint between cross-rod 20*c* and elongated rods 20*a*, 20*b* allows for bending of handle member 16 within the confines of housing 18 such that cross-rod 20*c* can travel out of engagement with the detent between ramp 56 and lower sidewall 38*c* to release the handle member so that it can freely travel towards the fully extended position. Upon reaching raised ridge 58, the pivotal joint again permits bending such that cross-rod 20*c* can travel up and over protrusion 58 and into engagement between the protrusion and the sidewall 38*d*. This pivotal connection facilitates ease of locking and unlocking the handle member during the retraction and extension procedure without transferring excessive pulling loads to the housing which could potentially degrade the attachment thereof to the suitcase, minimizes the necessary handle pulling load and provides greater reliability.

Figure 7:
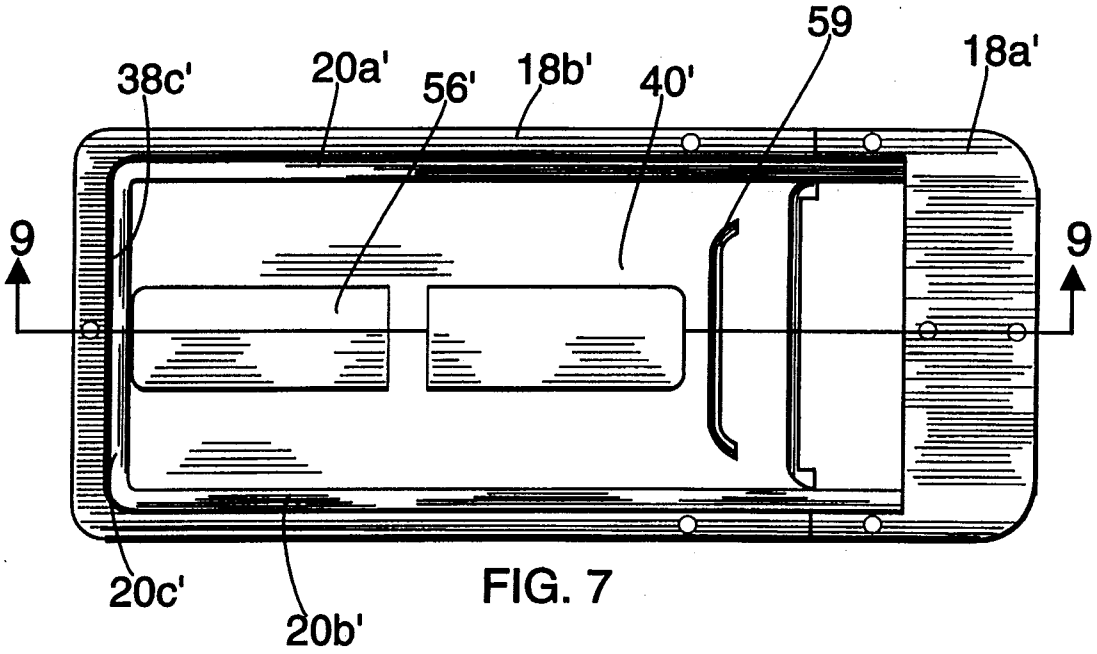
FIG. 7 is a top plan view of an alternative embodiment depicting the interior of the housing with the handle member disposed and locked in a retracted position.
Figure 8:
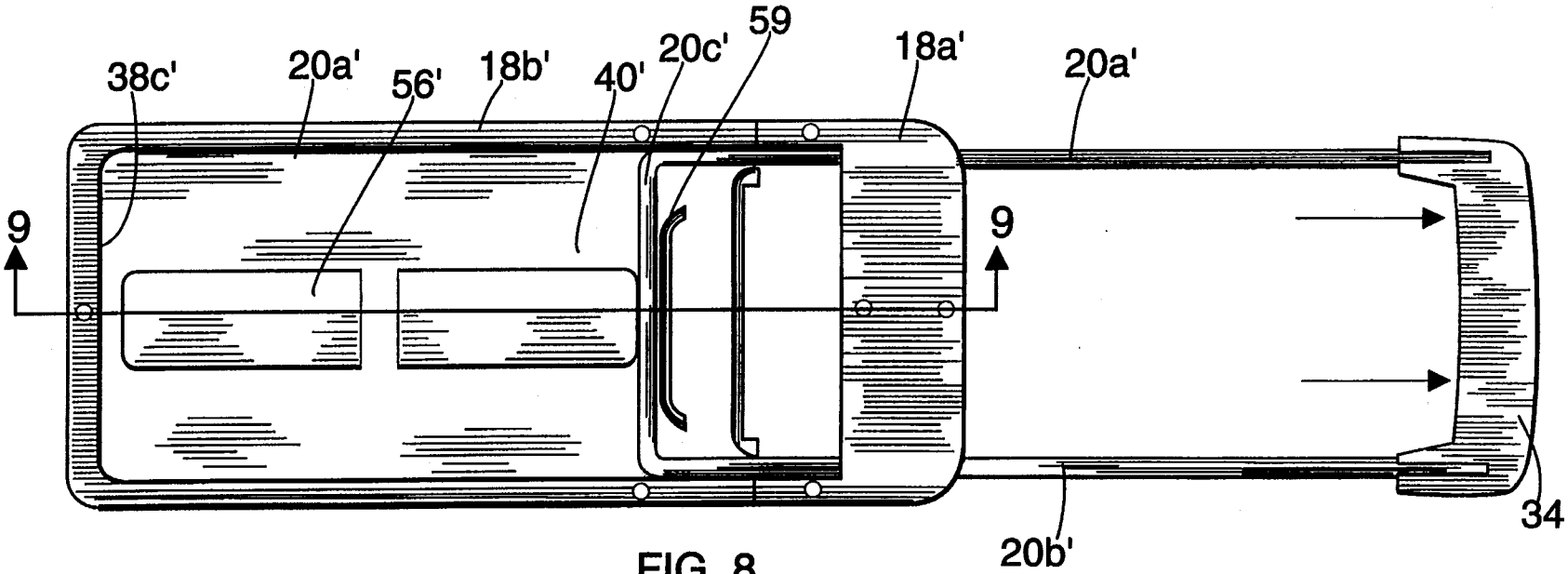
FIG. 8 is a top plan view of the alternative embodiment depicting the interior of the housing with the handle member disposed and locked in an extended position.
Figure 9:
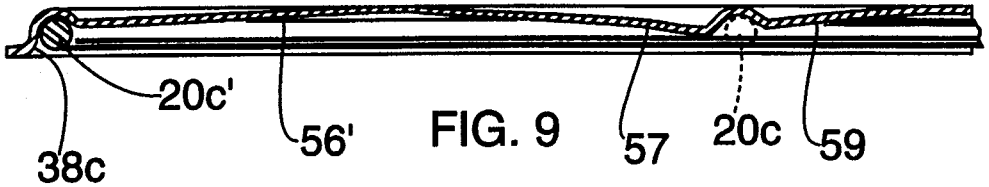
FIG. 9 is a sectional view along lines 9—9 in FIG. 7 showing detail of the respective locking detents for retaining the handle member in the retracted and extended positions.

In applications where the suitcase is fabricated from very soft materials, it is anticipated that the pivotal joint can be omitted since lateral displacement of the handle member during locking and unlocking with the respective detents in the housing will be absorbed by the surface of the suitcase. FIGS. 7–9 depict an alternate embodiment in which housing assembly 18' is comprised of two sections, 18*a'* and 18*b'*. Housing section 18*b'* includes a ramp 56' in front wall 40' to form a first detent with lower sidewall 38*c'* and confronting first 57 and second 59 ramp surfaces to form a second detent. Handle member 16' is unitarily comprised of two axially elongated rods 20*a'*, 20*b'* and transverse cross-rod 20*c'* to form the bottom end of the handle member, and a grasping member 34 attached to rods 20*a'*, 20*b'* as in the first embodiment described above and depicted in FIGS. 1 and 2A–2C. As illustrated in FIGS. 7 and 9, handle member 16' is in a retracted and locked position when cross-rod 20*c'* is retained between ramp 56' and lower sidewall 38*c'*. FIGS. 8 and 9 depict handle member 16' in an extended position with cross-rod 20*c'* engaged by ramp surfaces 57 and 59.

The present invention has been shown and described in what is considered to be the most practical and preferred embodiment. It is anticipated, however, that departures may be made therefrom and that obvious modifications will occur to persons skilled in the art.

I claim:

1. A retractable luggage handle for a suitcase of the type having rollers to facilitate transport thereof, the handle mechanism comprising:

a handle member having a first portion and a second portion, wherein said first and second portions are connected with means for pivoting said first portion relative to said second portion, and wherein said handle member is constructed as a generally U-shaped member having two axially elongated rods in spaced-apart parallel relationship and an integral cross-rod including a portion transversely disposed relative to said axially elongated rods to form a bottom end of said handle member, said handle member having integral means for grasping thereof disposed opposite said transverse rod to form a top end of said handle member; and an elongated housing fixedly attached to said suitcase and defining an interior volume for slidably receiving said handle member therein, said housing having integral first means for retaining said handle member in a retracted position relative to said housing and integral second means for retaining said handle member in an extended position relative to said housing.

2. The handle mechanism recited in claim 1, wherein said means for pivoting comprises a flexible member and said first and second portions of said handle member are joined by said flexible member at the interface thereof.

3. A retractable luggage handle for a suitcase of the type having rollers to facilitate transport thereof, the handle mechanism comprising:

a generally U-shaped handle member having two axially elongated rods in spaced-apart parallel relationship and an integral cross-rod including a portion transversely disposed relative to said axially elongated rods to form a bottom end of said handle member, said handle member having integral means for grasping thereof disposed opposite said cross-rod to form a top end of said handle member; and an elongated housing fixedly attached to said suitcase and defining an interior volume for slidably receiving said handle member therein, said housing having integral first detent means for engaging and retaining said handle member in a retracted position relative to said housing, and integral second detent means for engaging and retaining said handle member in an extended position relative to said housing, said handle member being pivotal relative to said housing when in said extended position.

4. The handle mechanism recited in claim 1, wherein said axially elongated rods include integral means for pivoting said cross-rod relative to said axially elongated rods.

5. The handle mechanism recited in claim 4, wherein said means for pivoting comprises a flexible member and said axially elongated rods include respective mating ends and are joined by said flexible member with said cross-rod at the interface thereof.

6. The handle mechanism recited in claim 5, wherein said flexible member is a spring having first and second ends, each fixedly attached to said respective mating ends of said axially elongated rods, said spring being covered with a tubular flexible sheath.

7. The handle mechanism recited in claim 3, wherein said housing is defined by two generally elongated sidewalls, a lower transverse sidewall and an upper transverse sidewall, said sidewalls being integral with an elongated front wall to form said interior volume of said housing, said upper transverse sidewall defining at least one aperture therethrough for receiving said axially elongated rods of said handle member, said first detent means disposed proximal to said lower transverse sidewall for restricting axial movement of said handle member away from said lower transverse sidewall of said housing when in said retracted position, said second detent means disposed proximal to said upper transverse sidewall for restricting axial movement of said handle member away from said upper transverse sidewall of said housing when in said extended position.

8. A retractable luggage handle for a suitcase of the type having rollers to facilitate transport thereof, the handle mechanism comprising:

a generally U-shaped handle member having two axially elongated rods in spaced-apart parallel relationship, and an integral cross-rod including a portion transversely disposed relative to said axially elongated rods to form a bottom end of said handle member, wherein said axially elongated rods include integral means for pivoting said cross-rod relative to said axially elongated rods, said handle member further including integral means for grasping thereof disposed opposite said cross-rod to form a top end of said handle member; and an elongated housing fixedly attached to said suitcase and defining an interior volume for slidably receiving said handle therein, said housing having integral first detent means for retaining said handle member in a retracted position relative to said housing and integral second detent means for retaining said handle member in an extended position relative to said housing.

9. The handle mechanism recited in claim 8, wherein said means for pivoting comprises a flexible member and said axially elongated rods include respective mating ends and are joined by said flexible member with said cross-rod at the interface thereof.

10. The handle mechanism recited in claim 9, wherein said flexible member is a spring having first and second ends, each fixedly attached to said respective mating ends of said axially elongated rods, said spring being covered with a tubular flexible sheath.

11. The handle mechanism recited in claim 10, wherein said housing is defined by two generally elongated sidewalls, a lower transverse sidewall and an upper transverse sidewall, said sidewalls being integral with an elongated front wall to form said interior volume of said housing, said upper transverse sidewall defining at least one aperture therethrough for receiving said axially elongated rods of said handle member, said first detent means disposed proximal to said lower transverse sidewall for restricting axial movement of said handle member away from said lower transverse sidewall of said housing when in said retracted position, said second detent means disposed proximal to said upper transverse sidewall for restricting axial movement of said handle member away from said upper transverse sidewall of said housing when in said extended position, said handle member being pivotal relative to said housing when in said extended position.

12. A retractable luggage handle mechanism for a suitcase of the type having rollers to facilitate transport thereof, the handle mechanism comprising:

a generally U-shaped handle member having two axially elongated rods in spaced-apart parallel relationship, and an integral cross-rod including a portion transversely disposed relative to said axially elongated rods to form a bottom end of said handle member, wherein said axially elongated rods and said cross-rod include integral means for pivoting said cross-rod relative to said elongated rods, said pivoting means comprising a flexible member and said axially elongated rods including respective mating ends which are joined by said flexible member with said cross-rod at the interface thereof, said handle member further including integral means for grasping thereof disposed opposite said transverse rod to form a top end of said handle member; and an elongated housing fixedly attached to said suitcase and defining an interior volume for slidably receiving said handle member therein, said housing having integral first detent means for retaining said handle member in a retracted position relative to said housing, and integral second detent means for retaining said handle member in an extended position relative to said housing, wherein said housing is defined by two generally elongated sidewalls, a lower transverse sidewall and an upper transverse sidewall, said sidewalls being integral with an elongated front wall to form said interior volume of said housing, said upper transverse sidewall defining at least one aperture therethrough for receiving said axially elongated rods of said handle member, said first detent means disposed proximal to said lower transverse sidewall for restricting axial movement of said handle member away from said lower transverse sidewall of said housing when in said retracted position, said second detent means disposed proximal to said upper transverse sidewall for restricting axial movement of said handle member away from said upper transverse sidewall of said housing when in said extended position.

13. A retractable luggage handle mechanism for a suitcase of the type having rollers to facilitate transport thereof, the handle mechanism comprising:

a generally U-shaped handle member having two axially elongated rods in spaced-apart parallel relationship, and an integral cross-rod transversely disposed relative to said axially elongated rods to form a bottom end of said handle member, said handle member further including integral means for grasping thereof disposed opposite said transverse rod to form a top end of said handle member; and an elongated housing fixedly attached to said suitcase and defining an interior volume for slidably receiving said handle member therein, wherein said housing is defined by two generally elongated sidewalls, a lower transverse sidewall, and an upper transverse sidewall defining at least one aperture therethrough for receiving said axially elongated rods of said handle member, said sidewalls being integral with an elongated front wall to form said interior volume of said housing, said housing having first detent means for retaining said handle member in a retracted position and second detent means for retaining said handle member in an extended position.

14. The handle mechanism recited in claim 13, wherein said first detent means in said housing is formed by the combination of an integral first ramp surface defined in said front wall and said lower transverse sidewall, and said second detent means in said housing is formed by confronting second and third ramp surfaces defined in said front wall.

15. A retractable luggage handle for a suitcase of the type having rollers to facilitate transport thereof, the handle mechanism comprising:

a handle member having a first portion and a second portion, wherein said first and second portions are connected with means for pivoting said first portion relative to said second portion; and an elongated housing fixedly attached to said suitcase and defining an interior volume for slidably receiving said handle member therein, said housing having integral first means for retaining said handle member in a retracted position relative to said housing and integral second means for retaining said handle member in an extended position relative to said housing, wherein said housing is defined by two generally elongated sidewalls, a lower transverse sidewall and an upper transverse sidewall, said sidewalls being integral with an elongated front wall to form said interior volume of said housing, said upper transverse sidewall defining at least one aperture therethrough for receiving said handle member, said first means defining a detent disposed proximal to said lower transverse sidewall for restricting axial movement of said handle member away from said lower transverse sidewall of said housing when in said retracted position, said second means defining a detent disposed proximal to said upper transverse sidewall for restricting axial movement of said handle member away from said upper transverse sidewall of said housing when in said extended position.

* * * * *